US005965829A

United States Patent [19]

Haynes et al.

[11] Patent Number: 5,965,829

[45] Date of Patent: Oct. 12, 1999

[54] RADIATION ABSORBING REFRACTORY COMPOSITION

[75] Inventors: Thomas G. Haynes, Midlothian; Kevin Anderson, Richmond, both of Va.; Edward L. Oschmann, Fort Wayne, Ind.

[73] Assignee: Reynolds Metals Company, Richmond, Va.

[21] Appl. No.: 09/059,389

[22] Filed: Apr. 14, 1998

[51] Int. Cl.[6] ..... C22C 29/04

[52] U.S. Cl. ..... 75/238; 75/244; 75/249; 420/528

[58] Field of Search ..... 75/249, 238, 244; 420/528

[56] References Cited

U.S. PATENT DOCUMENTS

| | | | |
|---|---|---|---|
| 1,944,183 | 1/1934 | Kempf et al. . | |
| 2,727,996 | 12/1955 | Rockwell et al. . | |
| 3,000,802 | 9/1961 | Worn et al. . | |
| 3,325,279 | 6/1967 | Lawrence et al. . | |
| 3,736,128 | 5/1973 | de Cadenet et al. . | |
| 3,795,042 | 3/1974 | Kreider et al. . | |
| 4,198,322 | 4/1980 | Storm . | |
| 4,213,883 | 7/1980 | Owens . | |
| 4,218,622 | 8/1980 | McMurtry et al. . | |
| 4,225,467 | 9/1980 | McMurtry et al. . | |
| 4,275,174 | 6/1981 | Tadokoro et al. . | |
| 4,277,680 | 7/1981 | Rodriguez et al. . | |
| 4,292,528 | 9/1981 | Shaffer et al. . | |
| 4,293,598 | 10/1981 | Hortman et al. . | |
| 4,297,976 | 11/1981 | Bruni et al. . | |
| 4,430,387 | 2/1984 | Nakagawa et al. . | |
| 4,437,013 | 3/1984 | Hondorp . | |
| 4,447,729 | 5/1984 | Doroszlai et al. . | |
| 4,453,081 | 6/1984 | Christ et al. . | |
| 4,474,728 | 10/1984 | Radford . | |
| 4,522,744 | 6/1985 | Argall et al. . | |
| 4,569,822 | 2/1986 | Brown et al. . | |
| 4,595,559 | 6/1986 | Planchamp . | |
| 4,603,665 | 8/1986 | Hesterberg et al. . | |
| 4,605,440 | 8/1986 | Halverson et al. . | |
| 4,615,735 | 10/1986 | Ping . | |
| 4,644,171 | 2/1987 | Mollon . | |
| 4,705,095 | 11/1987 | Gaspar . | |
| 4,711,823 | 12/1987 | Shiina | 428/547 |
| 4,744,922 | 5/1988 | Blakely et al. | 252/478 |
| 4,751,021 | 6/1988 | Mollon et al. | 252/478 |
| 4,806,307 | 2/1989 | Hirose et al. | 420/528 |
| 4,818,308 | 4/1989 | Odani et al. | 148/437 |
| 4,821,694 | 4/1989 | Hesterberg et al. | 123/195 R |
| 4,826,630 | 5/1989 | Radford et al. | 252/478 |
| 4,853,179 | 8/1989 | Shiina | 419/28 |
| 4,865,645 | 9/1989 | Planchamp | 75/294 |
| 4,865,769 | 9/1989 | Anayama | 252/478 |
| 4,938,810 | 7/1990 | Kiyota et al. | 148/437 |
| 4,992,242 | 2/1991 | Faure | 420/535 |
| 5,049,450 | 9/1991 | Dorfman et al. | 428/570 |
| 5,057,150 | 10/1991 | Reeve et al. | 75/671 |
| 5,156,804 | 10/1992 | Halverson et al. | 376/419 |
| 5,169,462 | 12/1992 | Morley et al. | 148/439 |
| 5,234,514 | 8/1993 | Donahue et al. | 148/549 |
| 5,273,709 | 12/1993 | Halverson et al. | 419/45 |
| 5,333,156 | 7/1994 | Lemercier | 376/219 |
| 5,366,691 | 11/1994 | Takeda et al. | 420/548 |
| 5,391,522 | 2/1995 | Goto et al. | 501/4 |
| 5,416,333 | 5/1995 | Greenspan | 250/515.1 |
| 5,437,746 | 8/1995 | Usui et al. | 148/439 |
| 5,441,554 | 8/1995 | Romero et al. | 75/255 |
| 5,478,220 | 12/1995 | Kamitsuma et al. | 418/55.2 |
| 5,506,055 | 4/1996 | Dorfman et al. | 428/407 |
| 5,532,194 | 7/1996 | Kawashima et al. | 501/9 |
| 5,554,428 | 9/1996 | Bartges et al. | 428/64.1 |
| 5,561,829 | 10/1996 | Sawtell et al. | 419/13 |
| 5,586,926 | 12/1996 | Wedell et al. | 451/59 |
| 5,613,189 | 3/1997 | Carden | 428/565 |
| 5,624,475 | 4/1997 | Nadkarni et al. | 75/238 |
| 5,626,935 | 5/1997 | Goto et al. | 428/64.1 |
| 5,669,059 | 9/1997 | Carden | 419/12 |
| 5,700,962 | 12/1997 | Carden | 75/236 |
| 5,712,014 | 1/1998 | Carden | 428/65.6 |
| 5,722,033 | 2/1998 | Carden | 419/12 |

FOREIGN PATENT DOCUMENTS

| | | |
|---|---|---|
| 612045 | 1/1961 | Canada . |

OTHER PUBLICATIONS

Wu et al., "Microstructure and Mechanical Properties of Spray–Deposited Al–17Si–4.5Cu–0.6Mg Wrought Alloy," Metallurgical and Materials Transactions A, vol. 26A, May, 1995, pp. 1235–1246.

*Primary Examiner*—Ngoclan Mai
*Attorney, Agent, or Firm*—Alan M. Biddison

[57] ABSTRACT

An extruded metal matrix composite incorporates boron carbide in fine particulate form. The composition is useful as a radiation shield.

19 Claims, 5 Drawing Sheets

50μm

RADIATION ABSORBING REFRACTORY COMPOSITION

TECHNICAL FIELD

This invention lies in the art of radiation shielding, and more particularly in the field of radiation shielding compositions including boron or a boron containing compound in particulate form within a metallic matrix.

BACKGROUND OF THE INVENTION

Due to its unique combination of relatively low cost, low toxicity and high radiation absorption capacity, boron has long been used for shielding of neutron radiation in connection with nuclear reactors. Boron has a high absorption cross section, a meaning that the probability is high that a neutron passing through a sheet or layer containing boron atoms will interact with a boron nucleus and hence be prevented from passing through. Native boron contains both $B^{10}$ and $B^{11}$ isotopes, the former having a fivefold higher neutron absorption capacity than the latter. Through an enrichment process, the $B^{10}$ content can be increased above the naturally occurring level of about 19 atomic percent.

Generally, radiation shields using boron are in the form of a composite material. This is necessitated by the inability of boron, or compounds thereof (e.g., boron carbide), to provide minimum acceptable levels of thermal shock resistance, fracture toughness and tensile strength. Incorporating boron into a composite can provide greater control of the physical properties of the shield since the non-boron components can be selected for strength or other important properties rather than their radiation shielding effect. Despite this greater control, however, prior art boron composites have suffered from many drawbacks.

It is known, for example, to mix isotopic $B^{10}$ (i.e., highly enriched boron) with molten aluminum and then cast it as an ingot. The ingot is then rolled to form a sheet. During the casting process there is significant clumping of the boron due to solidification effects. The clumped boron particles, due to their larger size, are prone to fracturing during the rolling step, which in turn causes smearing of the boron into "stringers," i.e., elongated boron particulates. This can be seen in FIG. 1, which is a photomicrograph of a boronated aluminum alloy formed using an ingot metallurgy technique. The large particles in the photomicrograph are clumped boron carbide particulates. During the rolling process, some of the clumps fracture and form stringers which can be in excess of 300 $\mu$m in length. Void spaces are formed between the fractured particles which may lead to corrosion. Furthermore, the performance of the shield is degraded because of the loss of uniformity caused by clumping and subsequent fracturing.

Why this occurs can be explained in terms of the measurement of "nearest neighbor distance" between the boron particulates. In a highly uniform matrix, the distance between adjacent boron particulates falls within a narrow statistical distribution. Thus, throughout the matrix, the distance between a given boron particle and the nearest neighboring particle is relatively constant. Conversely, the more non-uniform the distribution, the greater the variance in nearest neighbor distance. The clumping of boron particulates during casting increases the non-uniformity due to migration of smaller particulates from more uniformly distributed positions into consolidated larger particulates. FIG. 2 is a histogram of nearest neighbor distances for the same boronated aluminum alloy of FIG. 1. As can be seen from FIG. 2, the nearest neighbor distances vary widely with a standard deviation of 14.95 $\mu$m.

The effect of nearest neighbor distance on radiation absorption is as follows. Neutron radiation entering a matrix with uniform distribution of boron particulates will be absorbed at a uniform rate according to the statistical probability of the neutrons encountering a boron nucleus. However, for a non-uniform matrix, the neutron absorption is also non-uniform. In areas of the matrix where the nearest neighbor distances are small, for example, neutrons are successfully intercepted. Where the nearest neighbor distances are large, significant radiation may pass through because the statistical odds of encountering a boron nucleus are diminished. Since pass through of radiation over even small areas of the matrix is generally unacceptable, non uniform matrices have limited utility. Neutron absorption by non-uniform matrices can be enhanced by increasing the percentage of $B^{10}$ in the particulates, however, highly enriched boron is expensive and significantly increases the cost of the radiation shielding. The absorption may also be increased by increasing the thickness of the shield. This solution also has drawbacks because the shield must fall within specified weight and size restrictions.

An alternative to casting and rolling is powder metallurgy. This technique holds the promise of providing highly uniform dispersions of boron particulates. Prior to the present invention, however, the full benefit of this technique had not been realized. Also, compromises in shield effectiveness were necessary in order to provide adequate adhesion of the powder particulates. U.S. Pat. No. 5,700,962, for example, describes metal matrix compositions formed by blending a metal matrix powder material with boron carbide powder. Included with the boron carbide powder are small amounts of silicon, iron and aluminum, which function as chelating agents by forming intermetallic bonds with the metal matrix material. The metal matrix material can be aluminum or an aluminum alloy. The powders are mixed, isostatically compressed, degassed, sintered and then extruded.

Prior to the sintering step, the ingots (billets) are heated to burn off binder and water. The composition of the binder is not disclosed, however, it is assumed to be organic in nature. This debinderizing step (designated S10 in FIG. 2 of the patent) results in microstructural discontinuities and limits the maximum size of the product. Although organic binders are fugitive, beyond an ingot diameter of about three inches, diffusion effects become significant enough to prevent complete removal of binder even at temperatures well above that of binder decomposition. If significant binder is left in the ingot, decomposition and subsequent generation of hydrogen gas can occur in later processing stages, e.g. welding, creating a hazardous explosive environment. Attempts to remove all the binder from large diameter billets results in long heating cycles and increased costs, as well as difficulties in controlling the debinderization conditions.

The use of chelating agents is also problematic because many of those mentioned in U.S. Pat. No. 5,700,962 can significantly degrade performance of the neutron shielding material. Iron in particular is very harmful because it transmutates to radioactive isotopes with longer half lives.

Another approach to radiation shielding is the product known as BORAL, manufactured by AAR Advanced Structures. This product is a composite plate material having a core of mixed aluminum and boron carbide particles with aluminum cladding on both sides. This structure cannot be welded and is furthermore subject to corrosion if the aluminum cladding is breached. Since the core is not full density, hydrogen gas can be rapidly generated in the presence of water and result in blistering of the skin/cladding layer.

Hence, there remains a need in the art for a radiation shielding composition which can be easily manufactured, is not subject to corrosion, can be formed into a variety of shapes, including structurally self supporting elements, can be welded, and which form strong metal particle-to-metal particle bonds without the need for binders or chelating agents.

SUMMARY OF THE INVENTION

It is accordingly an aspect of the invention to provide a radiation shielding material which is easy to manufacture.

It is another aspect of the invention to provide a radiation shielding material having high radiation absorption capacity.

It is yet another aspect of the invention to provide a radiation shielding material which is structurally self supporting.

It is another aspect of the invention to provide a radiation shielding material including an aluminum alloy matrix that exhibits outstanding corrosion resistance in both wet and dry spent fuel storage environments.

It is another aspect of the invention to provide a radiation shielding material that is weldable using inert gas welding.

It is another aspect of the invention to provide a radiation shielding material having an anodizable composition for improved corrosion and emissivity.

These aspects and others set forth hereinbelow are achieved by a radiation shielding composition which comprises particulates of boron, or a boron-containing compound, in an aluminum or aluminum alloy matrix, the particulates comprising from about 2 to about 50% by volume and having a uniform distribution in the matrix characterized by a 50 percentile nearest neighbor distance of less than about 50 microns.

The aspects of the invention are also achieved by a method for forming an extruded radiation shield which comprises the steps of: (a) forming an aluminum or aluminum alloy powder having a mean particle size of from about 5 to about 40 microns; (b) mixing the powder of step (a) with particulates of boron or a boron-containing compound, thereby forming a particulate mixture; (c) compressing the particulate mixture to form a green billet, (d) sintering the green billet to form a sintered billet; and (e) extruding the sintered billet.

BRIEF DESCRIPTION OF THE DRAWINGS

For a fuller understanding of the invention, the following detailed description should be read in conjunction with the drawings, wherein.

DETAILED DESCRIPTION OF THE PREFERRED EMBODIMENTS

Figure 1:
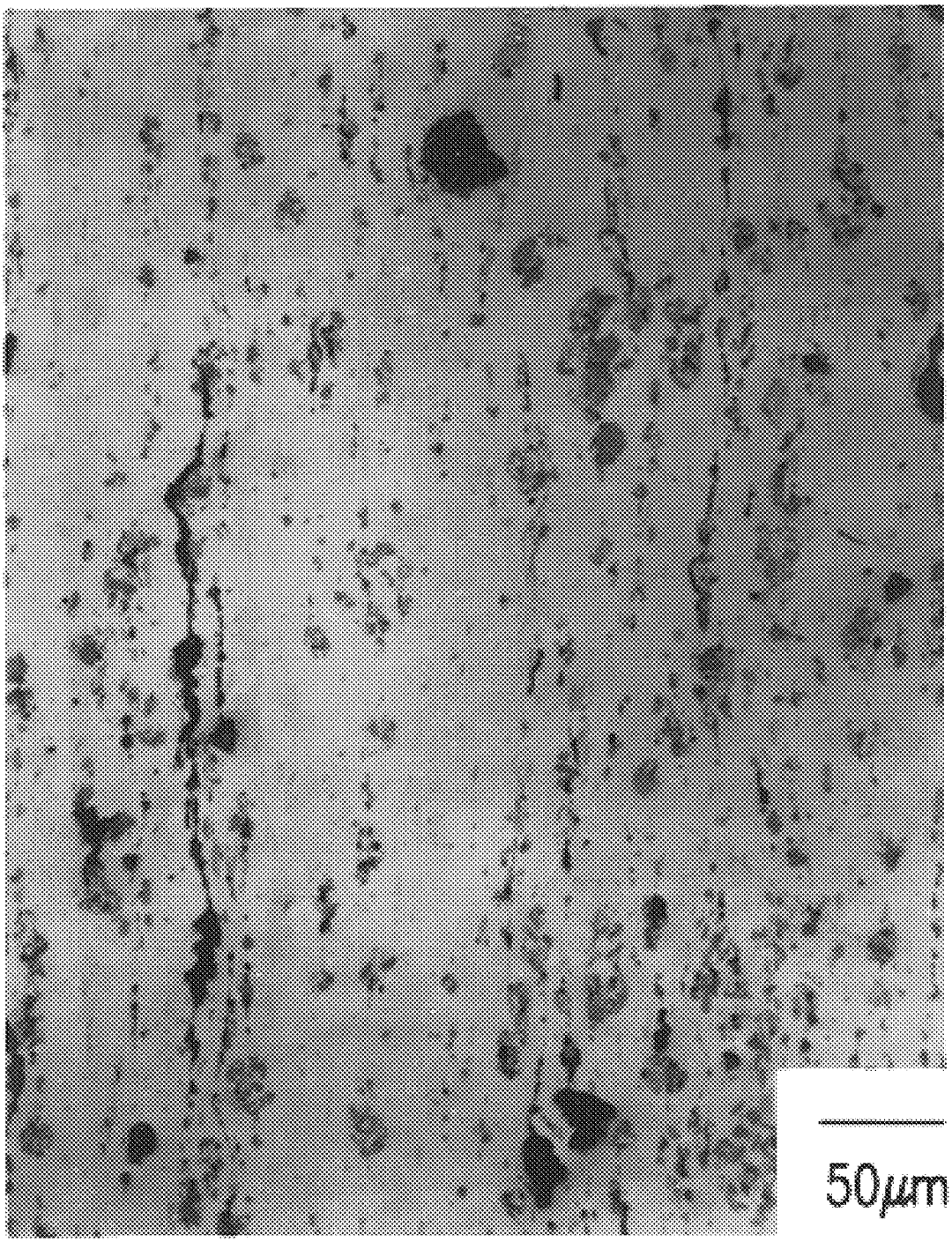
FIG. 1 ( PRIOR ART )
FIG. 1 is a photomicrograph of a prior art boronated aluminum alloy produced by ingot metallurgy technology.

The radiation shielding composition of the invention is formed by a process which involves the compaction, sintering and extrusion of a mixture of a metal matrix material and a boron-containing particulate material dispersed in the matrix. One of the features of the composite structure of the invention is that the boron-containing particulates are sufficiently small and evenly distributed to preclude fracturing. As mentioned above, fractured particles can smear during the rolling step, causing voids to form, which in turn can contribute to corrosion.

Another feature of the invention is the use of an extrusion process which provides for strong metal particle-to-metal particle bonds without the need for binders or chelating agents.

Another important feature of the invention is that the boron carbide particulates incorporated in the composition are readily available and meet ASTM 750 specification. This ASTM boron carbide has demonstrated outstanding performance in both hot section and spent fuel storage environments for over 40 years of service. The metal matrix incorporating the boron particulates is selected for its strength, radiation half life characteristics, and corrosion resistance in both boiling water reactor (BWR) and pressurized water reactor (PWR) wet environments and all dry storage and/or spent fuel storage applications.

Highly preferred as the matrix material are aluminum alloys. Generally, aluminum alloys useful in the invention have a combined total of iron, cobalt, manganese, copper and zinc of less than about 0.5 percent by weight and preferably less than about 0.3 percent by weight. Further, the combined amounts of nickel, cobalt and manganese are less than about 50 ppm total and preferably less than about 30 ppm total. The amount of cobalt is generally less than about 10 ppm and preferably less than 5 ppm. Suitable aluminum alloys include the 6000 series alloys, and most preferably a 6061 alloy having a composition low in Fe, Ni, Co, Mn, Cu, and Zn. These aluminum alloys are metallurgically well understood and are very widely used with a long history of good corrosion resistance and mechanical properties. When exposed to neutron radiation, very little long term radioactivity of the material is generated due to the alloys' chemical composition. This in turn is due to the fact that the primary elements in the alloy (Al, Si and Mg) all have relatively low cross-sections for neutrons and the isotopes formed from transmutation have short half-lives.

Conversely, materials having high Cu content (2000 series alloys), Zn (7000 series alloys), Mn and Fe (many 3000 series alloys), Ni and Co are quite radioactive after neutron irradiation because these elements transmutate into isotopes with longer half-lives. (For example, Co 60, etc.). It is therefore highly preferred that the aluminum alloys used in forming the radiation shield composition of the invention have a low percentage of these elements. The 6000 series alloys are also heat treatable with good strength and elevated temperature resistance. These 6000 series alloys can also be anodized and hard coated to improve corrosion resistance, abrasion resistance and emissivity, all of which are significant in dry cask storage applications. Dry casks are used to store spent nuclear reactor fuel prior to long term disposal. Further, because of their high strength, 6000 series alloys are capable of being used as structural elements. Not only can the material shield from neutron radiation, it can act as the supporting structure into which radioactive material is stored.

In a preferred embodiment, the aluminum alloy is in the form of a pre-alloyed powder formed by subjecting an aluminum alloy melt to a powder metallurgy technique. The term "pre-alloyed" means that the molten aluminum alloy bath is of the desired chemistry prior to atomization into powder. In a highly preferred embodiment, the alloy melt is passed through a nozzle to form an atomized stream of the melt which is cooled at a rapid rate by an inert gas stream (e.g., argon or helium) impinging the atomized stream. Cooling takes place at a rate of about 1000° C. (1832° F.) per second, producing a spherical-shaped powder. The powder has an oxide layer, but the thickness of this layer is minimized due to selection of inert gas as the cooling fluid. It is possible to use water on air as the cooling fluid, but the oxide layer thickness is increased. Preferably no other low melting alloy addition is blended with the alloy composition.

The aluminum alloy powder may be characterized by particle size distribution ("D"). The term "D10," for example, would indicate that 10% of the alloy particles have a particle size less than or equal to the assigned value (e.g. 6 μm). generally, the particle size distribution of the alloy powder has a D10 value of about 6.0 μm, a D50 of about 20 μm and a D90 value of about 38 μm. This particle size distribution may be measured by a Microtrac Analyzer (laser-based technology) or equivalent sedagraph. Desirably the D10, D50 and D90 values are about 4 μm, 12 μm and 25 μm, respectively, and preferably, the values are 2 μm, 9 Am and 17 μm, respectively. It is to be understood that the above stated values are independent of one another. Thus, a particle size distribution within the scope of the invention includes, for example, particles having a D10 of 4 μm, a D50 of 20 μm and a D90 of 17 μm.

The aluminum alloy powder is blended with boron-containing particulates comprising from about 2 to about 45% by volume of the overall composition. Desirably the amount of boron is from about 10 to about 40% by volume and desirably from about 15% to about 35% by volume of the overall composition. Preferably, the boron is in the form of boron carbide particulates. Generally, the boron carbide has a particle size characterized by a minimum of 98% less than 40 μm, desirably less than 30 μm and preferably 98% less than 20μm. In a highly preferred embodiment, the boron containing particulates comprise nuclear grade boron carbide powder prepared according to ASTM C750-89 (Type 1). This boron carbide powder has the following composition:

| Constituent | Chemical Requirements Weight % |
|---|---|
| Total Boron | 76.5 min |
| Total Boron + Carbon | 98.0 min. |
| $B^{10}$ Isotope | 19.90 ± .30 A/O* |
| $HNO_3$ Sol. Boron | 0.50 max. |
| Water Sol. Boron | 0.20 max.** |
| Iron | 1.0 max. |
| Fluoride | 25 μg/g max. |
| Chloride | 75 μg/g max. |
| Calcium | 0.3 max. |

Note:
*$B^{10}$ specified as atomic weight percent
**Specifying a maximum level of water soluble boron is important to limit leaching of free boron in certain environments.

The particle size of the boron carbide according to this standard is 98.0% min. less than 20 microns.

After the aluminum alloy powder and boron-containing particulates are uniformly mixed, they are subjected to a compacting step whereby the mixture is placed in a urethane elastomeric bag, tamped down and vibrated, and then subjected to vacuum to remove air and other gaseous materials. The vacuum is generally 10 torr or less absolute pressure, desirably about 1 torr or less and preferably about 0.50 torr or less absolute pressure. After vacuum is applied for a period of from about 2.5 to about 5 minutes, the compressed particulates are subjected to isostatic compression at a pressure of at least about 30,000 psi, desirably at least about 45,000 psi, and preferably at least about 60,000 psi. This isostatic compaction takes place at a temperature of less than about 212° F. (100° C.), desirably less than about 122° F. (50° C.), and preferably less than about 77° F. (25° C.), i.e. about room temperature.

The resulting "green" billet is then vacuum sintered at a temperature which is a function of the particular alloy composition, and is such that during the sintering process the particulate microstructure is left substantially unaffected. By the term "substantially unaffected" is meant that while the majority of the sinter bonds are formed by metallic diffusion, a small amount of melting can occur, however, this amount does not change the physical properties of the aluminum alloy powder to an extent that would affect the strength of the subsequently formed article. Generally, the sintering temperature is within 50° F. (28° C.) of the solidus of the particular composition, but may be higher or lower depending on the sintering characteristics desired. The term "solidus" refers to the point of the incipient melting of the alloy and is a function of the amount of alloying materials present, e.g. magnesium, silicon, etc. The vacuum under which sintering takes place is generally 100 torr or less absolute pressure, desirably 10 torr or less, and preferably about 1 torr or less absolute pressure.

The sintered billet may then be subjected to additional processing such as extrusion or other hot working processes. In a preferred embodiment, the sintered billet is extruded using the process described hereinbelow. This extrusion process has the advantage that strong metal particle-to-metal particle bonds are formed. As the sintered billet is extruded, the sintered particulates abrade against each other as they pass through the extrusion die. This abrading process removes the naturally occurring metal oxides on the outer surfaces of the aluminum particles, exposing the underlying metal and allowing a strong metal to metal bond to be formed. This phenomenon is in contrast to that occurring in the process described in U.S. Pat. No. 5,700,962, which employs a chelating agent to bind the particulates.

A preferred extrusion process includes provisions for maintaining extrusion die temperature within close tolerances, i.e. within about ±50° F. (28° C.) of a target temperature, desirably within about ±30° F. (17° C.), and preferably within about ±15° F. (8° C.) of a target temperature. The actual target temperature is itself a function of the particular alloy being extruded but is typically between about 930° F. (499° C.) and about 970° F. (521° C.). It is highly preferred that the extrusion temperature not exceed the solidus temperature. The extrusion temperature is preferably measured at the exit of the die, thus accounting for temperature effects due to friction and working of the billet.

Figure 3:
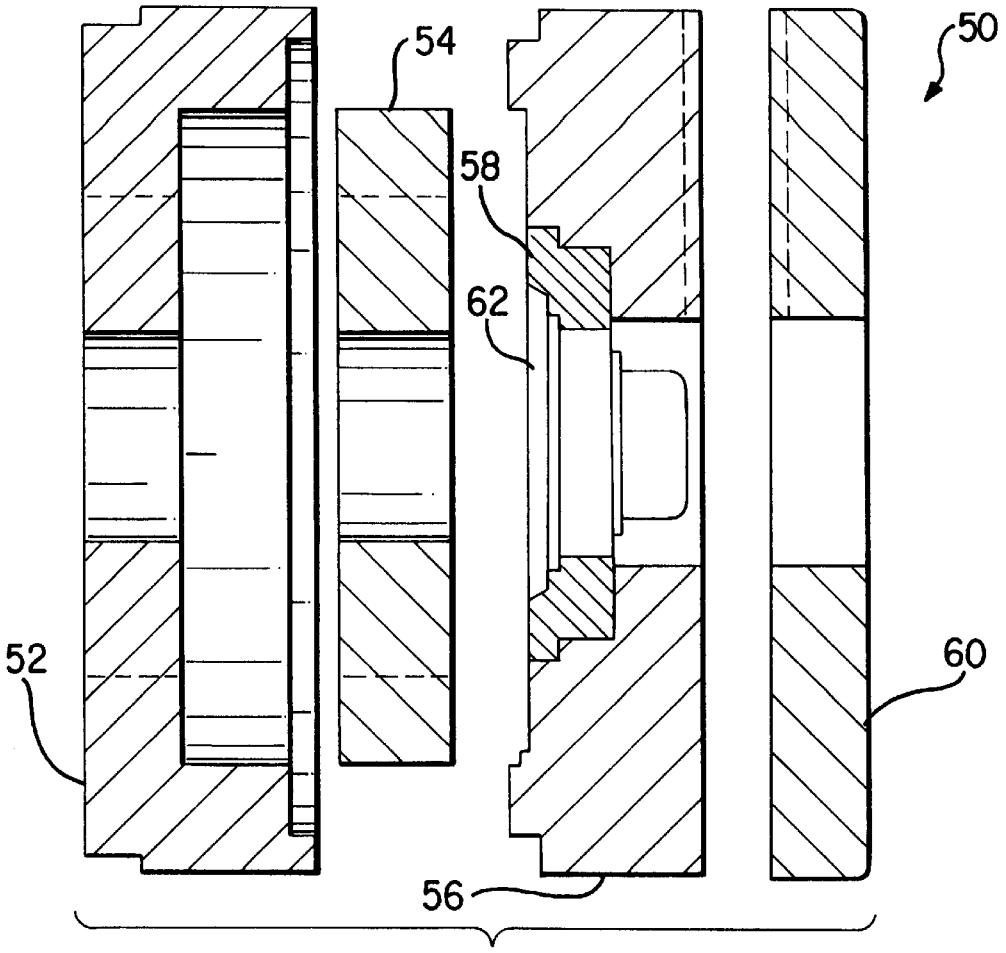
FIG. 3 is an exploded schematic of one embodiment of an extrusion die used in the invention.

As illustrated in FIG. 3, an extrusion die useful in the invention is indicated generally by the number 50 and includes a feeder plate 52, a mandrel/spider 54, and O.D. bearing plate 56, a die insert holder assembly 58 and a backer plate 60. All of the sections are interference fitted to be in compression at the extrusion die temperature. The compression fit strengthens the die to prevent deflection of the die components. Within the die holder assembly 58 is fitted a bearing retainer assembly 62.

Figure 4:
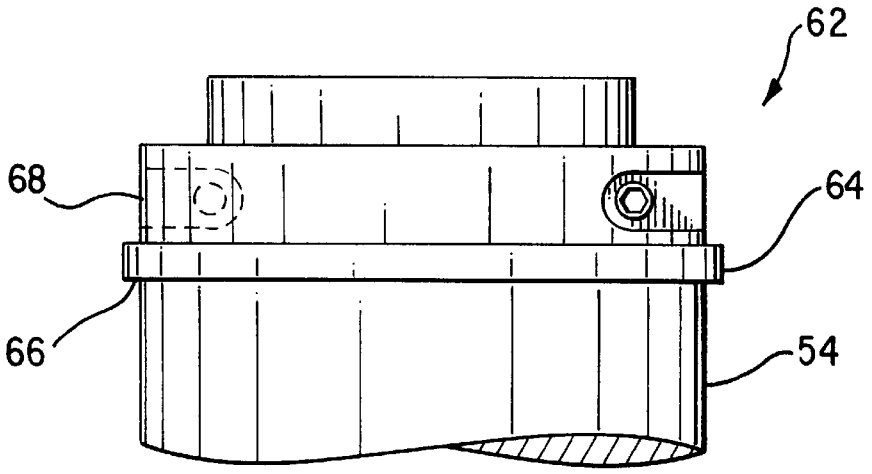
FIG. 4 is a schematic of a bearing retainer assembly of the extrusion die of FIG. 3.

FIG. 4 illustrates the bearing retainer assembly in detail. As shown in FIG. 4, a nonmetal insert 64 is positioned on a recessed surface 66 of the mandrel/spider 54. Over the insert 64 is placed a collar 68. Within the bearing retainer assembly is a pocket (not shown) for preworking the alloy prior to final extrusion through the O.D. bearing plate 56. The pocket has an entry angle of from about 30 to 32° and is positioned about 0.75 inches prior to the O.D. bearing plate 56. As the material passes through the pocket, it is preworked by shearing action. This aids in removal of the oxide layer from the particulates and in forming metal to metal bonds.

One or more, and preferably all of the above components of the extrusion die may be constructed of Inconel 718 or another alloy having a yield strength equivalent to or greater than that of Inconel 718 at 900–1000° F. (482–538° C.) to prevent deflection or mandrel "stretch" due to high temperature creep. This is particularly important at die face pressures greater than 95,000 psi at 900° F. (482° C.). At die pressures below this level, the extrusion die may typically be constructed of H13 tool steel.

The nonmetal insert 64 is preferably micrograined tungsten carbide (less than one micron diameter grain size) with a cobalt binder level between about 12% and 15%. This material exhibits a minimum transverse rupture strength of 600,000 psi. The use of Inconel 718 as the die insert holder with the tungsten carbide insert minimizes the possibility of cracking of the insert due to differences in coefficient of thermal expansion.

The extrusion container temperature is maintained within the same temperature limits as the extrusion die. In both cases, this may be accomplished by microprocessor controlled resistance band heaters or cartridge type heaters strategically placed on the extrusion container. Temperature is measured by multiple thermocouples imbedded in the die and container adjacent the container surface (generally within ½ inch). Each portion of the extruder and die monitored by a thermocouple has independent temperature control.

Figure 2:
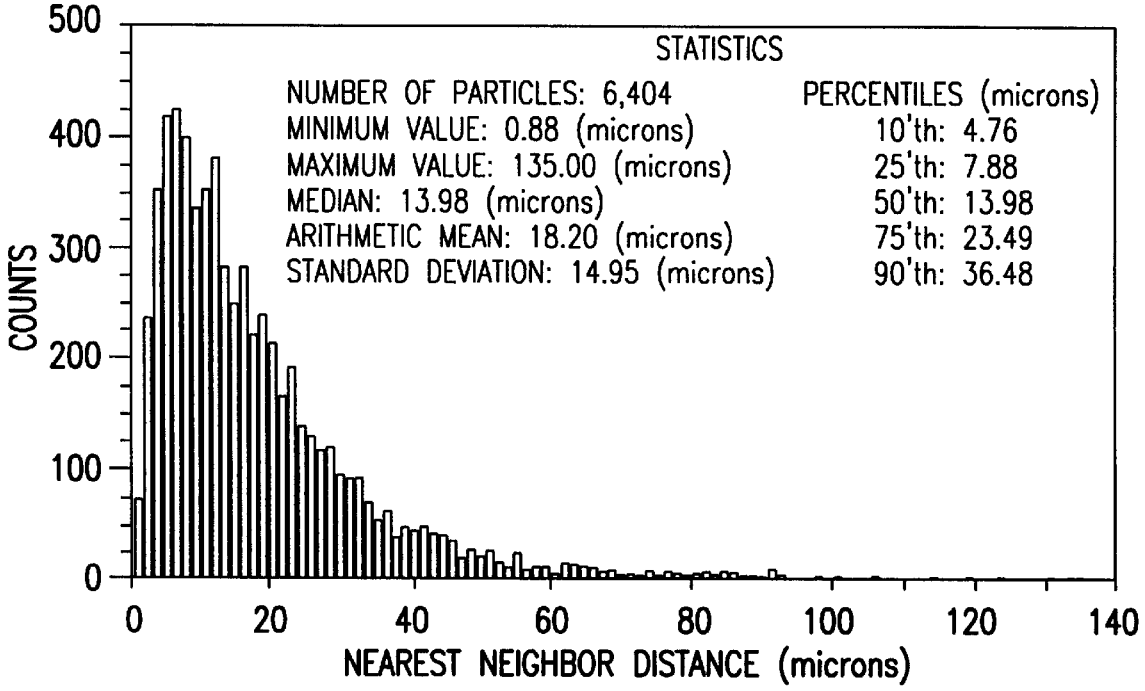
FIG.2 (PRIOR ART)
FIG. 2 is a histogram of nearest neighbor distance for the prior art boronated aluminum alloy of FIG. 1.
Figure 5:
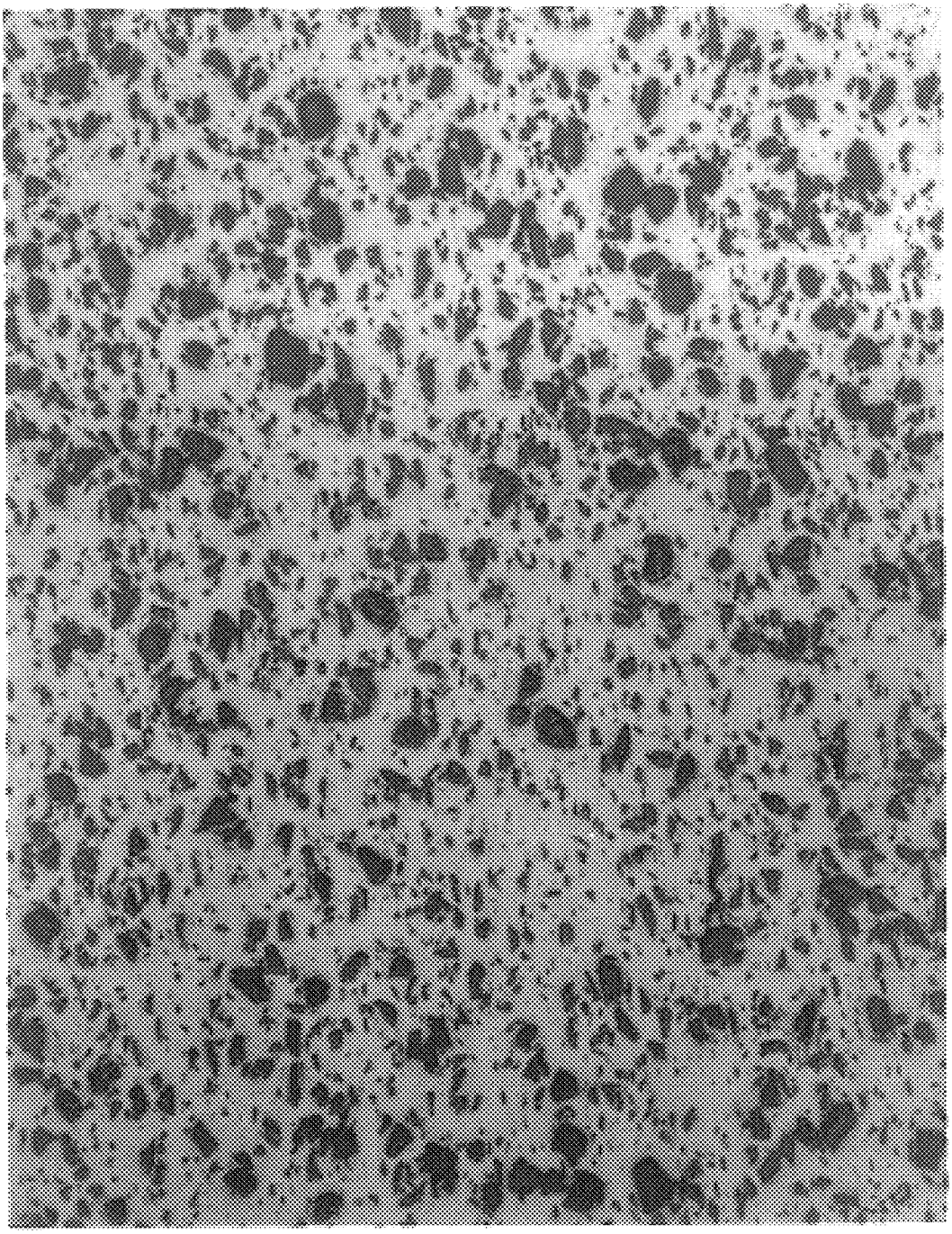
FIG. 5 is a photomicrograph of a metal matrix composite of the invention.
Figure 6:
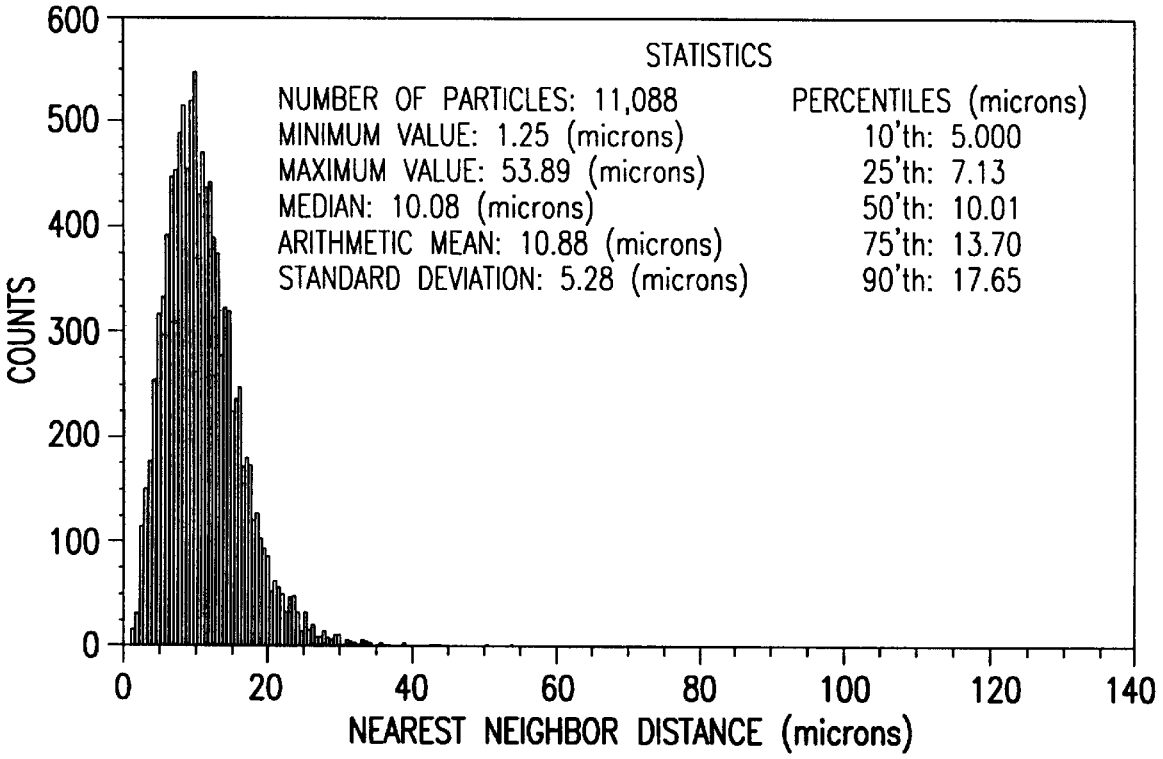
FIG. 6 is a histogram of nearest neighbor distance for the metal matrix composite of FIG. 5.

The microstructural homogeneity of the boron carbide particulate in the aluminum matrix can be quantified by reference to the nearest neighbor particle spacing measurement. As discussed earlier, this measurement technique quantifies the distance between adjacent particles of the boron carbide within the aluminum matrix. The matrix is a 6061 alloy with 21 wt % $B_4C$. The 50 percentile nearest neighbor distance is 10.01 $\mu$m, while the 90 percentile value is 17.65. The standard deviation is 5.28 $\mu$m. This represents a very narrow range of values and is indicative of a highly uniform matrix. FIG. 5 is a photomicrograph of a matrix alloy of the invention, and FIG. 6 graphically represents the nearest neighbor distances as a histogram. The uniform distribution of particulates as represented in FIGS. 5 and 6 is in contrast to the non-uniform distribution exhibited by prior art ingot metallurgy techniques as shown in FIGS. 1 and 2 discussed above.

In one embodiment, the 50 percentile nearest neighbor distance of the boron containing particulates is generally less than about 50 microns at a boron-containing particle loading of about 20 wt. %. desirably, the 50 percentile nearest neighbor distance of this embodiment is less than about 25 microns and preferably less than about 15 microns for a 20 wt. % particle loading. In particular embodiments, the 50 percentile neighbor distance is between about 6 and 11 microns and in a highly preferred embodiment is about 10 microns at a particle loading of 20 wt. %

Another measure of particle size distribution in the radiation shielding composition is the standard deviation of the particulate nearest neighbor distance. Generally, the standard deviation is less than about 15 microns at a 20 wt. % loading, desirably less than about 10 microns and preferably between about 4 and about 6 microns.

Both the particle size of the alloy powder and the boron containing material (refractory particulates) may be carefully controlled. The particle size relationship between the aluminum powder and the refractory particulates may be optimized for reproducibility of microstructure homogeneity. If too large a size between aluminum and boron containing material, the boron containing material will cluster together. The size and homogenous distribution of the boron carbide particulates in the matrix alloy is a factor in preventing neutron "streaming" and/or "channeling" through the composite cross-section.

The following example illustrates the invention:

EXAMPLE

Blending Operation

A pre-alloyed aluminum powder and boron carbide particulates are pre-weighed, added to a mixer, and mixed under a vacuum of 28 in. Hg for one hour. The aluminum powder is prealloyed 6061 alloy in the form of spherical particulates. This material has a melting point range of 1080–1205° F. (582–652° C.), a density of 0.098 lb/in$^3$ (2.71 g/cm$^3$) and a thermal conductivity of 1250 BTU/hr-ft$^2$-°F./in (1.55 kcal/hr-cm$^2$-°C./cm) and has the following composition:

| Element | Range |
|---|---|
| Magnesium | 0.80 –1.20 |
| Silicon | 0.40–0.80 |
| Copper | 0.15–0.40 |
| Iron | 015 max |
| Zinc | 0.25 max |
| Titanium | 0.15 max |
| Oxygen* | 0.05–0.50 |
| Nickel** | 50 ppm max |
| Cobalt** | 10 ppm max |
| Manganese** | 10 ppm |
| Chromium** | 10 ppm |
| Others/each | 0.05 max |
| Others/total | 0.15 max |
| A1uminum | Remainder |

*Oxygen is noted as a reference information that a powder metallurgy process is used to manufacture the product.

** Nicke1, Cobalt, Iron, Manganese and Chromium are tramp elements not covered by ASTM B 221 Specification but may be significant to the performance of nuclear grade aluminum/$B_4C$ metal matrix compsoites in a radiation environment to prevent transmutation of elements with longer half lives, thereby maintianing the short half life of aluminum material.

The particle size distribution is as follows:

| Distribution Curve | Particle Size Range Minimum | Maximum |
|---|---|---|
| D10 | 70 | 10 microns |
| D50 | 18 | 25 microns |
| D90 | 70 | 38 microns |

With 100% of the particles 1ess than 44 microns

The boron carbide particulate used conforms to ASTM C750-89 (Type 1). The mixing operation is done at room temperature and no organic binders or other additions are added to the batch. The mixing container is brought back to atmospheric pressure using nitrogen gas. The entire batch is processed through a Sweco Unit with a 200 mesh "supertaught plus" screen. This operation deagglomerates the Al/$B_4C$ mixture to prevent "cluster defects" in the compacted billet.

This screened mixture is placed back into the mixer and blended under vacuum for an additional 45–60 minutes. After this blending operation the mixing container is brought back to atmospheric pressure using nitrogen gas.

Billet Consolidation

A billet consolidation tooling consists of a stainless steel perforated basket, a urethane elastomeric bag, and a urethane top closure with a urethane deair tube. The perforated stainless basket is used to support the elastomeric mold during the mold fill operation and prevent bulging or distorting of the mold wall because of the hydrostatic pressure.

The elastomeric bag is filled with the $AlB_4C$ blend, vibrated, and tamped to obtain maximum packing and sealed. This tool assembly is evacuated to 28.5–29.0 in Hg to remove trapped air in the powder vacancies.

This evacuated elastomeric tooling is placed in a cold isostatic press (CIP) and a lightweight turbine oil is pressured to 55,000–60,000 psi pressure. The use of lightweight turbine oil eliminates the potential $H_2$ gas generation if the elastomeric tooling is not pressure tight. The pressurized turbine oil goes through the perforated stainless steel basket and pushes against the urethane bag wall which consolidates the loose powder blend. Once the peak pressure is reached, the CIP automatically retains the full pressure for a dwell time of 0.75 to 1.5 minutes.

After the dwell time is completed, the vessel is decompressed back to atmospheric pressure at a preset rate of 1500 psi/second. The elastomeric tooling is run through a low pressure/high volume pass through washer to remove residual oil. The elastomeric tooling is removed from the billet and can be reused several hundred times. The billet is now solid and is 82–95 percent of theoretical density.

Sintering Operation

The resulting green billet is loaded into the hot zone of a vacuum sintering furnace. A two stage degassing operation prior to sintering is used. In the first stage, a major vacuum "surge" occurs between 250–340° F. (121–171° C.) and is the stage in which the free water vaporizes off the green billet. The second stage occurs between 800–880° F. (427–471° C.), during which the chemically bonded water is removed from the hydrated oxide layer of the atomized aluminum powder. The vacuum level in the furnace recovers to a minimum vacuum level of 2.0×10–3 torr prior to proceeding to the final sintering temperature. The final sintering temperature depends on the matrix alloy. "Differential thermal analysis" is one of the techniques used to establish the final sintering temperature. Once the two stage degass is completed, the step is performed at the final set temperature. Upon completion of the sinter cycle, the hot zone is backfilled with low dew point nitrogen gas to cool down the furnace load. The billet is now in the "sintered condition".

Extrusion Operation

A 3000 ton Sutton extrusion press is used under the following conditions:

Billet Temp.—980–995° F. (527–535° C.)

Container Temp.—920–940° F. (493–504° C.)

Die Temperature—900–920° F. (482–493° C.)

Extrusion exit speed—7.5–8.0 feet/minute

The extrusion die has a fine grained tungsten carbide bearing insert that is interference fitted in an Inconel 718 insert holder to assure compression loading of the insert at the extrusion temperature. The die design also incorporates a 30–32 degree metal prework pocket prior to the final O.D. bearing to optimize particle to particle bond between the aluminum powder and the boron carbide particulate. All die components are interference fitted to assure compression loading at extrusion temperature to prevent die deflect.

During extrusion the die bearing area has a nitrogen gas "blanket" to optimize extrusion surface finish and prevent aluminum oxide buildup at the bearing land area. The extrusion is air cooled and stretch straighten prior to the cut-to-length operation.

What is claimed is:

1. A radiation shielding composition comprising particulates of boron or a boron-containing compound in an aluminum or aluminum alloy matrix, the particulates comprising from about 2 to about 45% by volume, and having a uniform distribution in the matrix characterized by a 50 percentile nearest neighbor distance of less than about 50 microns.

2. A radiation shielding composition as claimed in claim 1, wherein the 50 percentile nearest neighbor distance of the particulates is less than about 25 microns.

3. A radiation shielding composition as claimed in claim 1, wherein the 50 percentile nearest neighbor distance of the particulates is less than about 15 microns.

4. A radiation shielding composition as claimed in claim 1, wherein the 50 percentile nearest neighbor distance of the particulates is between about 6 and about 11 microns.

5. A radiation shielding composition as claimed in claim 1, wherein the 50 percentile nearest neighbor distance of the particulates is about 10 microns.

6. A radiation shielding composition as claimed in claim 1, wherein the standard deviation of the particulate nearest neighbor distance is less than about 15 microns.

7. A radiation shielding composition as claimed in claim 1, wherein the standard deviation of the particulate nearest neighbor distance is less than about 10 microns.

8. A radiation shielding composition as claimed in claim 1, wherein the standard deviation of the particulate nearest neighbor distance is between about 4 and about 6 microns.

9. A radiation shielding composition as claimed in claim 4, wherein the standard deviation of the particulate nearest neighbor distance is less than about 10 microns.

10. A radiation shielding composition as claimed in claim 2, wherein the standard deviation of the particulate nearest neighbor distance is between about 4 and about 6 microns.

11. A radiation shielding composition as claimed in claim 1, wherein the particulates comprise boron carbide.

12. A radiation shielding composition as claimed in claim 5, wherein the particulates comprise boron carbide.

13. A radiation shielding composition as claimed in claim 10, wherein the particulates comprise boron carbide.

14. A radiation shielding composition as claimed in claim 11, wherein the boron carbide has a $B^{10}$ content of from about 18 to about 20% by weight.

15. A radiation shielding composition as claimed in claim 12, wherein the boron carbide has a $B^{10}$ content of from about 18 to about 20% by weight.

16. A radiation shielding composition as claimed in claim 13, wherein the boron carbide has a $B^{10}$ content of from about 18 to about 20% by weight.

17. A radiation shielding composition as claimed in claim 1, further comprises iron, cobalt, manganese, copper and zinc in a combined amounts of less than about 0.5 percent by weight.

18. A radiation shielding composition as claimed in claim 1, further comprises nickel, cobalt, and manganese in an amount less than about 50 ppm total.

19. A radiation shielding composition as claimed in claim 1, further comprises less than 10 ppm cobalt.

* * * * *